United States Patent [19]

Conrad

[11] Patent Number: 4,477,803

[45] Date of Patent: Oct. 16, 1984

[54] STRIPCHART RECORDER INTENSITY ENHANCEMENT

[75] Inventor: Richard J. Conrad, Hamilton, Mass.

[73] Assignee: Hewlett-Packard Company, Palo Alto, Calif.

[21] Appl. No.: 317,090

[22] Filed: Nov. 2, 1981

[51] Int. Cl.[3] ..... G09G 1/16

[52] U.S. Cl. ..... 340/722; 340/728; 346/110 V

[58] Field of Search ..... 340/728, 722, 747; 346/110 R, 110 VT, 108

[56] References Cited

U.S. PATENT DOCUMENTS

| | | | |
|---|---|---|---|
| 3,474,438 | 10/1969 | Lauher | 340/722 |
| 4,038,668 | 7/1977 | Quarton | 340/728 |
| 4,212,009 | 7/1980 | Adleman et al. | 340/728 |
| 4,307,393 | 12/1981 | Hamada et al. | 340/728 |
| 4,311,997 | 1/1982 | Madni | 340/728 |

*Primary Examiner*—Marshall M. Curtis
*Attorney, Agent, or Firm*—Donald N. Timbie

[57] ABSTRACT

A system for displaying a voltage wave wherein the wave and a delayed version of the wave are separately compared with a voltage ramp that is proportional to the position of an electron beam is changed between the point where the voltage ramp equals the voltage of the voltage wave and the point where the voltage ramp equals the voltage of the delayed version of the wave.

5 Claims, 2 Drawing Figures

STRIPCHART RECORDER INTENSITY ENHANCEMENT

BACKGROUND OF THE INVENTION

One way of displaying an analog wave representing a physiological function on a cathode ray tube in which the electron beam successively scans a series of parallel lines is to generate a ramp voltage that is proportional to the position of the electron beam as it scans each line and compare it with the analog wave. At the point of coincidence, the electron beam is intensity modulated so as to produce a bright dot. Thus, the analog wave is sampled once during the scanning of each line so as to build up an image formed from a series of dots.

In the portion of the analog wave having little slope, the dots are nearly touching so as to form a seemingly continuous line, but in portions of the analog wave having large slope, the dots are spread apart along the scanned lines so as to form a weak discontinuous line.

In order to overcome this problem, circuits have been provided that stretch the dots into line segments that fill in the spaces between the dots. Unfortunately, these circuits are complex and expensive.

BRIEF DESCRIPTION OF THE INVENTION

As in the prior art, a display system incorporating this invention is provided with a comparator having an output signal that changes from a first state to a second as the ramp previously referred to passes from a lower value through the value of the analog signal and means responsive to the change for turning on the beam of the cathode ray tube so as to produce a dot on the screen for a brief instant. In addition, however, a display system incorporating this invention includes means for delaying the analog signal, a comparator for producing an output signal that changes from a state corresponding to said first state to a state corresponding to said second state of said previously mentioned comparator when the ramp passes from a lower value through the value of the delayed analog signal and means for turning on the cathode ray tube as long as only one of the comparators produces an output signal having said first state. Thus, the cathode ray tube is turned on between the lesser of the analog or delayed analog signal and the greater.

DETAILED DISCUSSION OF THE INVENTION

Figure 1:
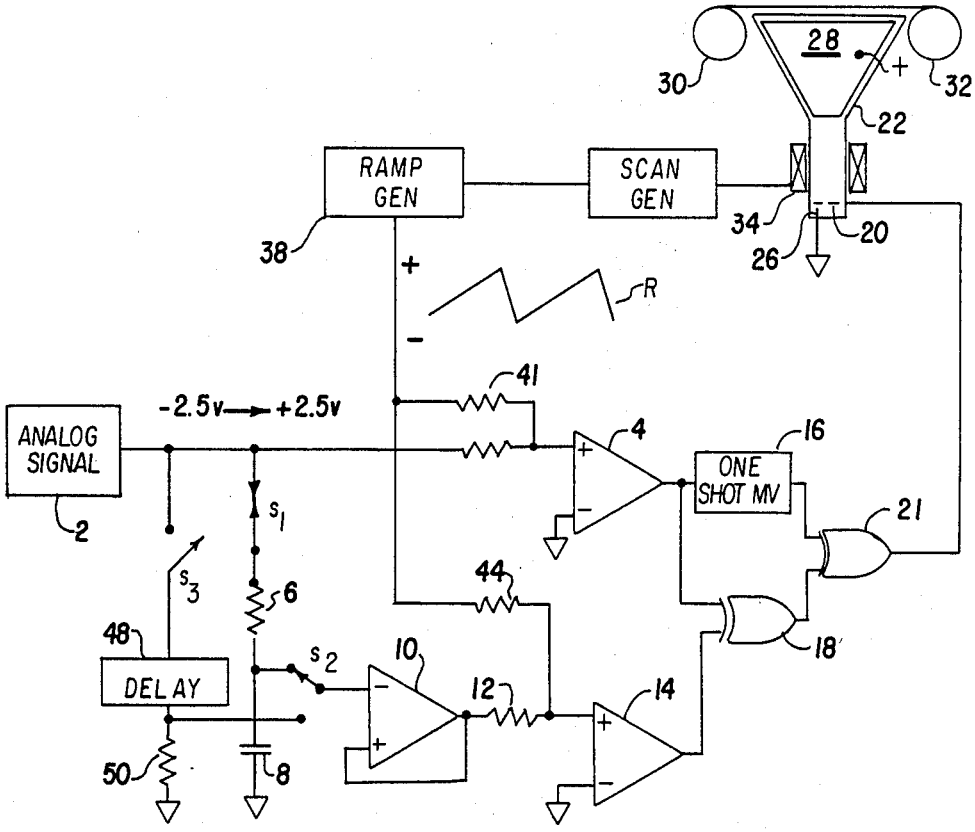
FIG. 1 is a schematic diagram of display apparatus incorporating this invention.

In FIG. 1, a source 2 of analog signals is connected via a resistor 3 to the non-inverting input of a first comparator 4, the inverting input of which is grounded. With switches $s_1$, $s_2$ and $s_3$ in the positions shown, the analog signals from a source 2 are delayed by delay means comprised of a resistor 6 and a capacitor 8 connected in series in the order named. The delayed analog signal appearing at the junction of the resistor 6 and the capacitor 8 is connected via a switch $s_2$ and input 9 of a buffer amplifier 10 and a resistor 12 to the non-inverting input of a second comparator 14, the inverting input of which is grounded. The output of the first comparator 4 is connected so as to trigger a one-shot multivibrator 16 and to one input of an exclusive-or gate, XOR 18, the other input of which is connected to the output of the second comparator 14. A control grid 20 of a cathode ray tube 22 is connected to the output of an OR gate 21 having one input connected to the output of the one-shot multivibrator 16 and the other input connected to the output of the XOR 18. The cathode 26 of the cathode ray tube 22 is connected to a point of ground potential and its anode 28 is connected to a source of positive potential. If the analog signal is to be recorded, paper is moved across the face of the cathode ray tube 22 by rollers 30 and 32.

A scan generator 36 of a type well known to those skilled in the art is connected to deflection coils 34 for the cathode ray tube 22 so as to cause its electron beam to scan a series of parallel lines as the paper is moved. Ramps indicated at R are produced at the output of a ramp generator 38 that is coupled to the line scanning of the scan generator 36 so as to be synchronized therewith. Resistor 41 is connected in series between the output of the ramp generator 38 and the non-inverting input of the first comparator 4. Resistor 44 is connected in series between the output of the ramp generator 38 and the noninverting input of the second comparator 14.

With the voltage as indicated, an undelayed analog signal from the source 2 can place the non-inverting input of the first comparator 4 at ground potential at some time during a ramp R for any value of the analog voltage between −2.5 v and +2.5 v, and the delayed analog signal from the junction of the resistor 6 and the capacitor 8 can place the non-inverting input of the second comparator 14 at ground potential at some time during a ramp R for any value of the delayed analog voltage between −2.5 v and +2.5 v.

OPERATION

Figure 2:
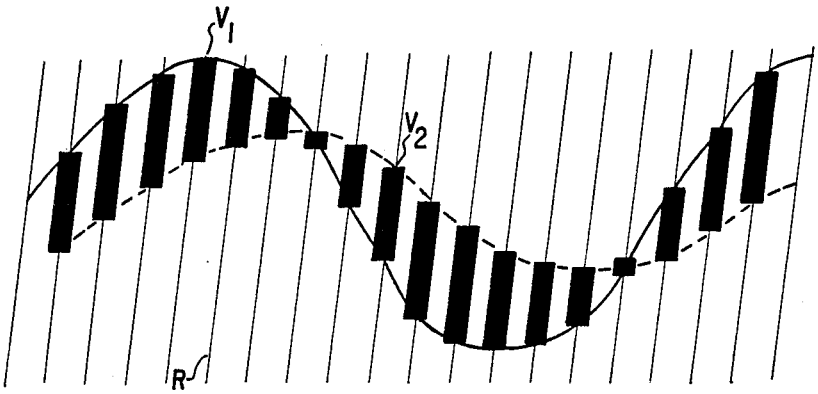
FIG. 2 is a graph used in explaining the operation of FIG. 1.

Assume that the solid line $v_1$ of FIG. 2 is the undelayed analog signal, the $v_2$ is the delayed analog signal and that the lines R are the ramps occurring during each line. Whenever the value of the ramp R passes up through the value of either $v_1$ or $v_2$, it causes the corresponding comparator, i.e., 4 or 14 respectively, to output a high state. Because the XOR 18 outputs a high state only when the states applied to its inputs are different, it does so only during the portion of a ramp R lying between the curves $v_1$ and $v_2$ so as to keep the electron beam of the cathode ray tube 22 turned on during this period. For the purpose of illustration, the beam width is shown as being less than the spacing between lines, but its width is normally equal to the spacing so that there are no gaps. The OR gate 21 makes the grid 20 go high if the output of the multivibrator 16 or the output of the XOR 18 goes high. Note that $v_2$ is attenuated by virtue of the fact that the resistor 6 and capacitor 8 operate as a voltage divider. If the analog wave were always varying in amplitude, the one-shot multivibrator 16 could be eliminated, but it is necessary in the situation where $v_1$ is horizontal because the outputs of the comparators 4 and 14 would always be the same.

ALTERNATIVE

Instead of using the resistor 6 and capacitor 8 as a delay means, a true time delay 48 could be used in series with a resistor 50 so that the delayed analog signal $v_2$ appears across the resistor. This true delay can be inserted in the circuit by moving the switches $s_1$, $s_2$ and $s_3$ to their other positions. The delay should be not more than 180° at highest frequency to be displayed.

What is claimed is:

1. In apparatus for displaying an analog wave on the face of a cathode ray tube in which the electron beam is made to scan parallel lines in succession separated by a given interval, a circuit comprising means for generating a ramp voltage waveform that increases during each scanned line from a value that is less than the minimum expected value of the analog signal to a value that is greater than its maximum expected value, an input to which an analog signal to be displayed may be applied, first comparison means coupled to said input and to said means for generating a ramp waveform for producing a first signal whenever the amplitude of the ramp waveform is greater than the amplitude of the analog signal, means for providing delay coupled to said input, said means being capable of providing a delay that is the same as or different from a whole multiple of said given interval, second comparison means coupled to the output of said means for providing delay and to said means for generating a ramp waveform for producing a second signal whenever the amplitude of the ramp waveform is greater than the amplitude of the delayed analog signal, and means responsive to said first and second signals for producing a signal that can change the intensity of the beam of the cathode ray tube between the times when said first and second signals occur.

2. Apparatus as set forth in claim 1 wherein said means for providing delay operates in such manner that the analog wave at its output has the same shape as the analog wave applied to its input.

3. Apparatus as set forth in claim 1 wherein said means for providing delay is a low pass filter.

4. Apparatus as set forth in claim 1 further including means for producing a signal that can change the intensity of the cathode ray beam when said first and second signals occur at the same time.

5. Apparatus for displaying an analog wave, comprising a cathode ray tube having means for producing an electron beam and an electrode for controlling the intensity of said beam, means for causing said beam to successively scan parallel lines separated by a given interval, an input to which an analog wave to be displayed may be applied, delay means having a delay different from said given interval coupled to said input so as to provide a delayed version of an analog wave applied to said input, means for producing a signal for changing the brightness of said electron beam when it is scanning between the amplitudes of the analog wave and its delayed version and when both amplitudes are the same, and means for applying said signal to said control electrode.

* * * * *